US006296374B1

(12) United States Patent
Ahroni

(10) Patent No.: US 6,296,374 B1
(45) Date of Patent: Oct. 2, 2001

(54) DRAPING TYPE DECORATIVE LIGHT ASSEMBLY

(76) Inventor: Joseph M. Ahroni, 2701 W. Manor Pl. No. 204, Seattle, WA (US) 98199

( * ) Notice: Subject to any disclaimer, the term of this patent is extended or adjusted under 35 U.S.C. 154(b) by 0 days.

(21) Appl. No.: 09/636,726

(22) Filed: Aug. 9, 2000

(51) Int. Cl.[7] ..... F21S 4/00
(52) U.S. Cl. ..... 362/252; 362/806
(58) Field of Search ..... 362/249, 252, 362/806, 123, 391

(56) References Cited

U.S. PATENT DOCUMENTS 5,788,361 * 8/1998 Lee ..... 362/252
6,152,576 * 11/2000 Mount ..... 362/252
6,155,697 * 12/2000 Ahroni ..... 362/252

* cited by examiner

*Primary Examiner*—Stephen Husar
(74) *Attorney, Agent, or Firm*—Seed IP Law Group PLLC

(57) ABSTRACT

Three equal length sections of cord on which lights are mounted have three continuous length portions having different lengths which are arranged to bridge three spans of equal length. The spans are shorter than each of the three length portions. Each length section has its respective three length portions sequenced differently than the three length portions of the other two length sections so that the length portions bridging each span sag to three different levels. Attachments are provided at the ends of the spans.

12 Claims, 5 Drawing Sheets

DRAPING TYPE DECORATIVE LIGHT ASSEMBLY

TECHNICAL FIELD

The present invention relates to decorative light sets, and more particularly to "swag" sets in which strings of lights are configured to form multiple draping sections.

BACKGROUND OF THE INVENTION

Swag sets have become popular for holiday decorating but have been relatively complicated in assembly configuration. In some swag sets multiple drapes in a swag sectional have been provided by zig-zagging a light string back and forth in progressively longer sections. This invention aims to provide a simplified swag configuration by which three standard light strings, for example, can be easily arranged to provide a swag set with multiple swag sections each having multiple drapes.

SUMMARY OF THE INVENTION

In accordance with two embodiments of the invention each of three light strings is used to provide one of three drapes in each of three spans of drapes. This is accomplished by arranging each string so that it has three draping portions of different lengths which are sequenced differently in each of the three strings. The three light strings are supported at the beginning and ending of the three spans of drapes and are arranged in parallel or in series. In a third embodiment, the three light strings in the series embodiment are combined as a single string.

DETAILED DESCRIPTION OF THE INVENTION

Figure 1:
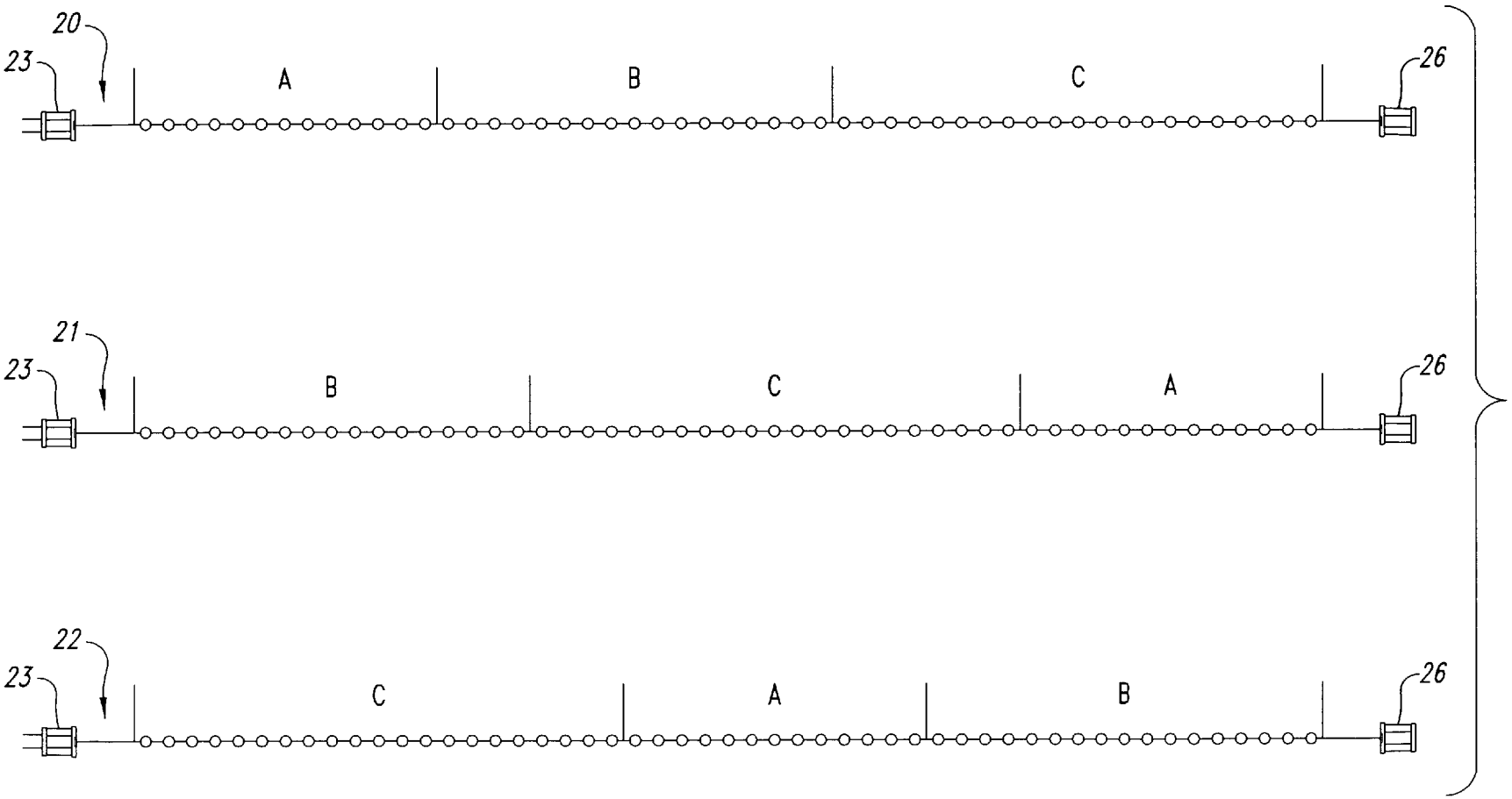
FIG. 1 is a layout showing an arrangement of three light strings for forming three spans of drapes in accordance with the invention.
Figure 2:
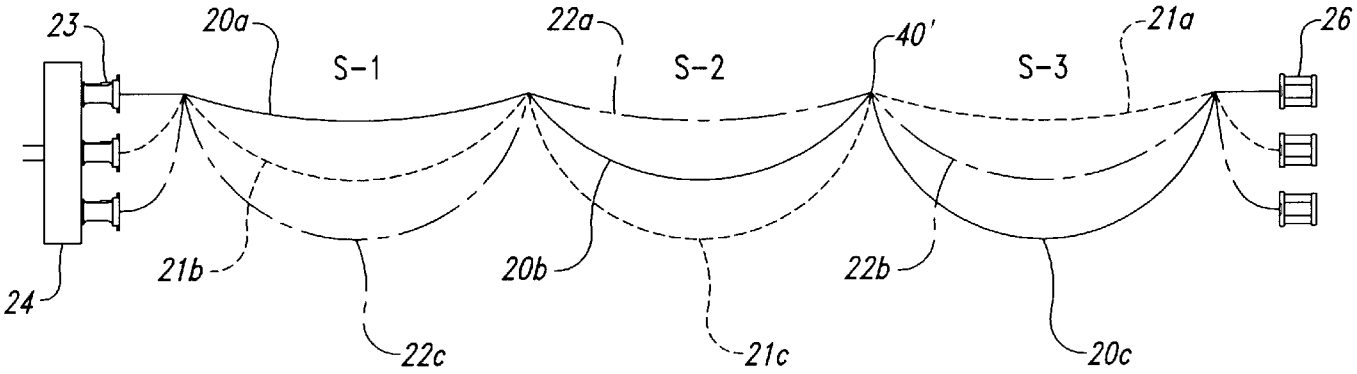
FIG. 2 is an elevational view illustrating the three light strings of FIG. 1 arranged in draping position as a first embodiment of the invention.

Referring to FIGS. 1 and 2, as a first embodiment three conventional miniature light strings 20, 21 and 22 are shown, each having an end plug 23 at one end plugged into a wall plug 24 of the type having three socket entries. At their other ends, the light strings may have add-on plugs 26 as end connectors. The light strings are preferably of the type wherein one of two wires 27–28 series connects light units

Figure 9:
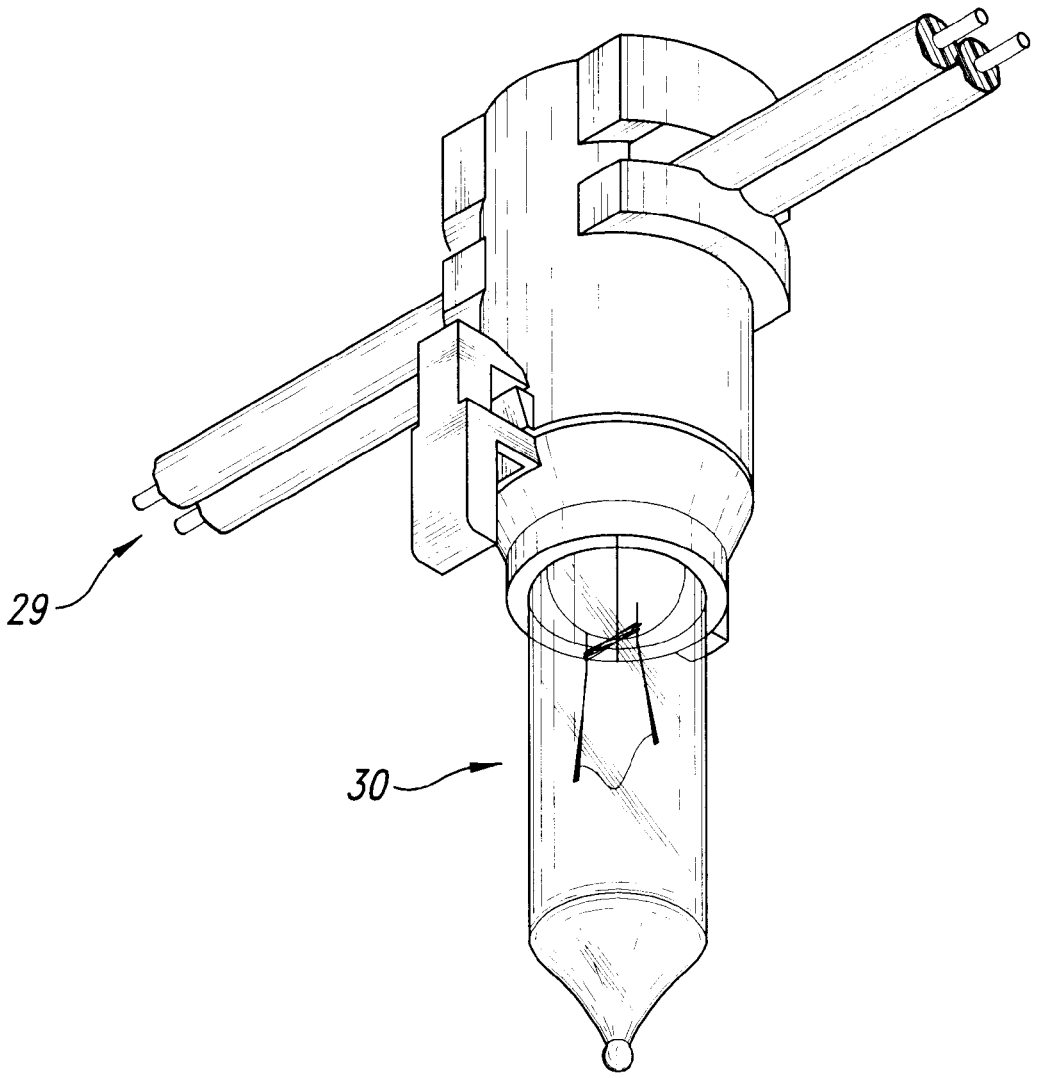
FIG. 9 is a front perspective view showing one of the light units in one of the light strings.

30 while the other wire functions as a ground return, and the two wires are side-by-side in an insulating cord 29. The light units 30 may be like those shown in U.S. Pat. No. 6,079,848, but having a wireway for a two-wire cord rather than a three-wire cord. Although not preferred, the wires can be individually insulated and wound together rather than as indicated in FIG. 9.

Each light string has a length section which may have 51 light units 30, for example. As indicated in FIG. 1, this length section, for purposes of explanation, may be divided longitudinally into three continuous length portions A, B, and C, having 21 lights (A), 17 lights (B), and 13 lights (C). In the illustrated example, light string 20 has its length portions sequenced ABC, light string 21 has its length portions sequenced BCA, and light string 22 has its length portions sequenced CAB. Preferably the lights in each string are equally spaced apart, as for example, spaced three inches from light center to light center.

This makes the three length portions in each light string have different lengths with portion C the longest and portion A the shortest, while portion B is mid-length between portions A and C. As a consequence if the three length portions each span a distance shorter than the length of portion A, for example, a distance of 35 inches, each length portion will sag in an arc with portion C sagging the most and portion A sagging the least. Hence, when portion A of string 20, portion B of string 21, and portion C of string 22, for example, are positioned to bridge a first span S-1, as indicated in FIG. 2, the result is that these three length portions drape to three different levels as illustrated. Likewise, when a second span S-2 is then bridged by portion A of string 22, portion B of string 20, and portion C of string 21, these three portions 22A, 20B and 21C will drape to substantially the same levels as portions 20A, 21B and 22C in the first span. And finally, when a third span S-3 of the same length is bridged by length portions 21A, 22B and 20C, the draping configuration will be duplicated again.

In the first embodiment, each span S-1, S-2 and S-3 contains a group of three length portions from three light strings. At the ends of the spans, support attachments which may comprise clips, hangers and/or ties are provided to hold the intersections 40' between the length portions together and suspend them. For example, the attachment may take the form of a hanger 40 having a hook 41 extending upwardly from the back of a bracket arm 42 formed at its upper side with three side-by-side recessed seats to hold the cords 29 of the light strings. A snap cover (not shown) may be provided. The stem 41*a* of the hook may be provided with a keyhole slot 41*b* to receive a nail or screw fastener. In the illustrated example, four of the hangers 40 are provided, one each at the beginning of the three spans S-1, S-2 and S-3, and fourth at the end of span S-3. These hangers may be hooked over a support wire or tied to a railing, for example, or nailed or screwed to a support by passing the fastener through the keyhole slots 41*b*. Although specialized support attachments are preferred, tie strings or wires may be tied around the cords of the three light strings at the beginning of spans S-1, S-2 and S-3, and at the end of span S-3, and connected to a fastener, railing, overhead cord or other convenient support.

It will be appreciated that more than three continuous spans of draping lights may be provided by utilizing longer light strings. For example, three 102-light strings may be used to provide six spans of draping lights in which the second group of three spans is a duplicate of the three illustrated spans. In this instance, each of the three strings can be divided into six continuous sections, with the first string configured in a ABCABC sequence, the second string configured in a BCABCA configuration, and the third string configured in a CABCAB configuration, for example.

In the illustrated example, all three string sections in each span sag downwardly in a respective arc. It will be appreciated that if desired, the upper section in each span can be relatively straight rather than sagged.

Figure 3:
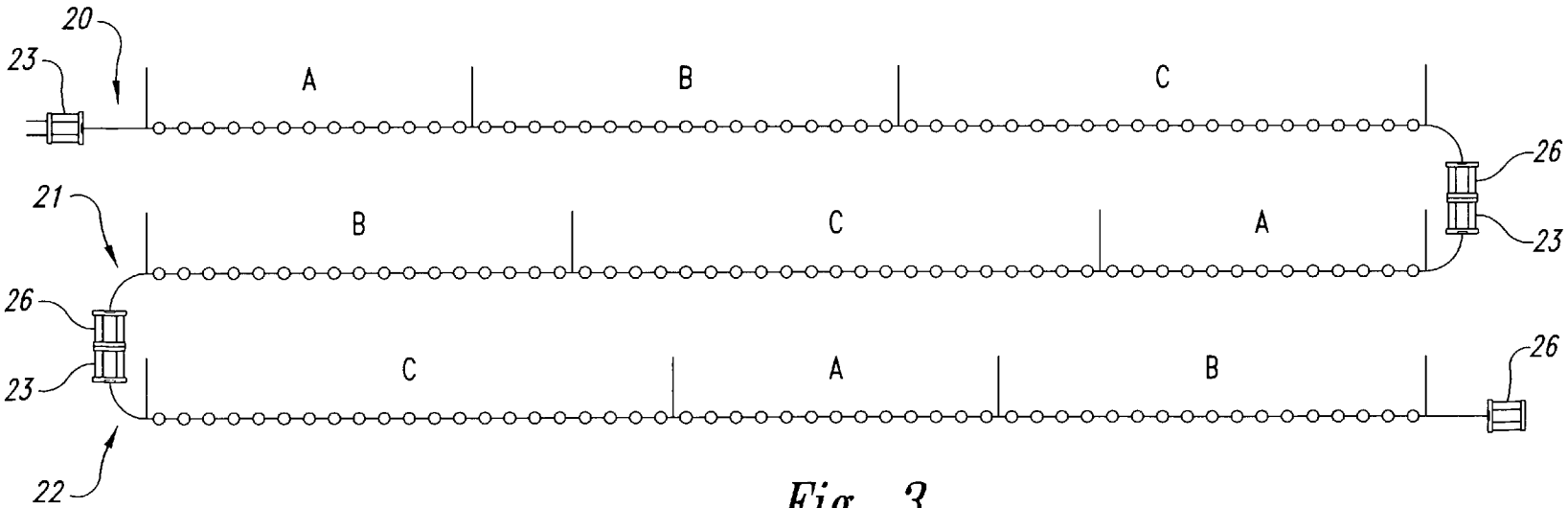
FIG. 3 is a layout showing three light strings connected together end-to-end to drape as a second embodiment.

In a second embodiment of the invention, indicated in FIG. 3, the three light strings 20–22 are rearranged so that the strings 21 and 22 are reversed end for end and have their wall plugs respectively plugged into the add-on plugs of strings 20 and 21. The order of the respective length portions A, B and C can remain the same as before, but commences on strings 21–22 starting from the add-on plug end rather than starting from the wall plug end as before.

Figure 4:
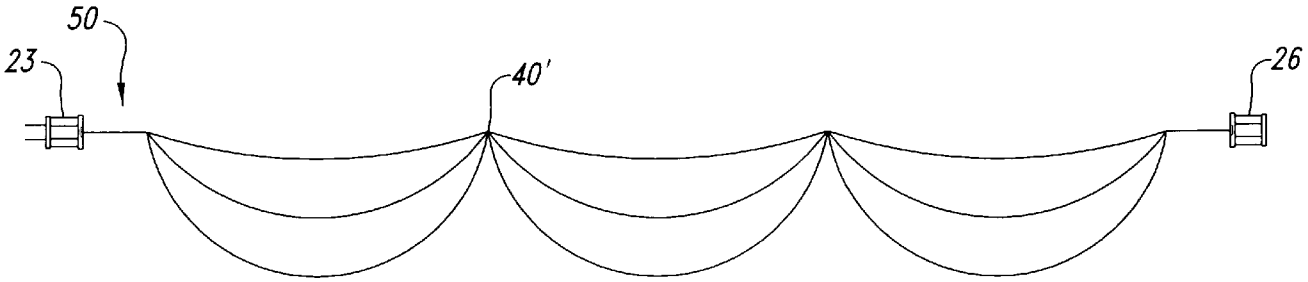
FIG. 4 is a view corresponding to FIG. 2 illustrating use of a single string of lights in a third embodiment to form three spans of drapes.
Figure 5:
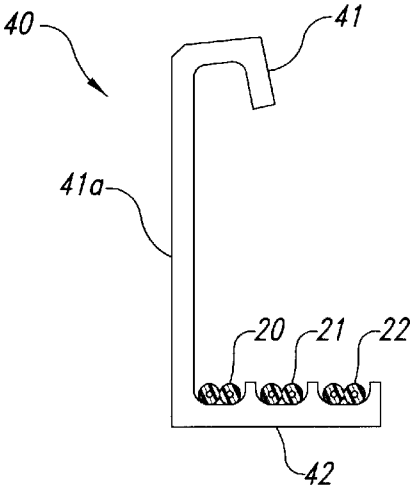
FIG. 5 is an elevational view of one of the support attachments taken at the location indicated by the line 5—5 in FIG. 1.
Figure 6:
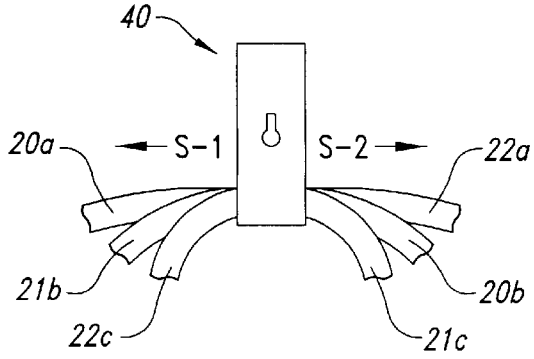
FIG. 6 is a rear elevational view of the support attachments and held cord sections when at the FIG. 5 location.
Figure 7:
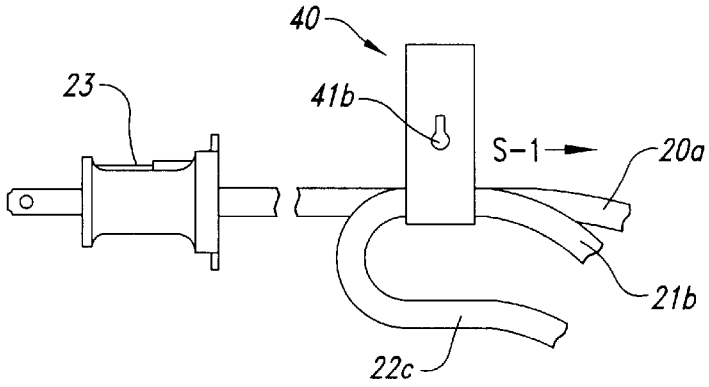
FIGS. 7 and 8 are rear elevational views of the support attachments and held cord sections at the beginning and end of the first and third spans of drapes.
Figure 8:
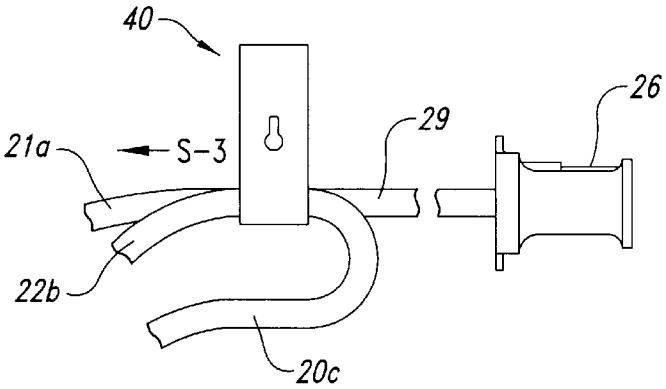

In a third embodiment of the invention, shown in FIG. 4, the three strings in the second embodiment which are arranged in series, are combined as a single light string 50 having three continuous end-to-end length sections of equal length each containing the three length portions A, B and C. The nine length portions in the string may be sequenced ABCACBCAB, for example. Thus it is seen that the three length sections having three length portions with different lengths, can be provided by three light strings arranged in parallel, or in series, or by a single longer light string.

What is claimed is:

1. A lighting display assembly comprising:

three light string sections having a cord with light units mounted thereon at regular intervals in the light string sections;

attachments at the beginning and end of each of three end-on-end spans of about equal length;

each of said string sections containing a length section having a length which is the sum of the lengths of three length portions each having a length different from the length of each of the other length portions, at least two of said length portions having a length greater than said spans;

the end-to-end order of said length portions in each of said length sections being different from the end-to-end order of the length portions in each of the other length sections;

each of said length sections bridging each of said spans by a respective one of its three length portions such that each span is bridged by three length portions of different lengths from different ones of said length sections; and each of said length portions being retained at its ends by respective ones of said attachments, whereby each of said spans is bridged by three length portions having their centers at three different levels.

2. A lighting display assembly according to claim 1 in which said three light string sections comprise three independent light strings each having an end plug.

3. A lighting display assembly according to claim 2 in which said end plugs are all plugged into one wall plug unit.

4. A lighting display assembly according to claim 1 in which said three light string sections comprise three independent light strings each having a wall plug at one end and an add-on plug at the other end thereof, a first of said light strings having its add-on plug engaged by the wall plug of a second one of said light strings, and the add-on plug of said second light string being engaged by the wall plug of a third one of said light strings.

5. A lighting display assembly according to claim 1 in which said three light string sections are provided by a single light string.

6. A lighting display assembly comprising:

three length sections of cord of about equal length having a series of light units mounted thereon, each of said length sections including three length portions having three different lengths and adapted to bridge three spans of about equal length which is less than the length of each of said length portions;

each of said three length sections having its respective three length portions sequences end-to-end differently than the three length portions of the other two length sections, whereby the three length portions bridging each span are from different of said length sections and sag to three different levels; and attachments at the ends of said spans for holding end portions of the three length sections.

7. A lighting display according to claim 6 in which said three length sections are provided by three light strings arranged in parallel relation.

8. A lighting display according to claim 6 in which said three length sections are provided by three light strings arranged in series.

9. A lighting display according to claim 6 in which said three length sections are continuous parts of a single light string.

10. A lighting display assembly according to claim 6 in which said light units in each of said three length sections are spaced apart the same distance.

11. A lighting display assembly comprising:

length sections of cord of about equal length having a series of light units mounted thereon, each of said length sections including the same number of length portions having different lengths, said length portions being arranged to bridge multiple spans of about equal length which is less than the length of each of said length portions;

each of said length sections having its length portions sequenced end-to-end differently than each of the other length sections so that the length portions bridging each span are from different of said length sections and sag to different levels; and support units at the ends of said length sections.

12. A lighting display assembly according to claim 11 in which there are three of said light sections each having three of said length portions, and there are three of said spans.

* * * * *